US011856666B2

(12) United States Patent
Gong et al.

(10) Patent No.: US 11,856,666 B2
(45) Date of Patent: Dec. 26, 2023

(54) ALTERNATING CURRENT SOURCE DIRECT DRIVING LED LIGHTING DEVICE

(71) Applicants: Myeong-Kook Gong, Yongin-si (KR); Da-Young Gong, Yongin-si (KR)

(72) Inventors: Myeong-Kook Gong, Yongin-si (KR); Da-Young Gong, Yongin-si (KR)

(73) Assignee: ISLT CO., LTD., Asan-si (KR)

( * ) Notice: Subject to any disclaimer, the term of this patent is extended or adjusted under 35 U.S.C. 154(b) by 182 days.

(21) Appl. No.: 17/598,157

(22) PCT Filed: Dec. 31, 2019

(86) PCT No.: PCT/KR2019/018768

§ 371 (c)(1),
(2) Date: Sep. 24, 2021

(87) PCT Pub. No.: WO2020/204315

PCT Pub. Date: Oct. 8, 2020

(65) Prior Publication Data

US 2022/0174799 A1 Jun. 2, 2022

(30) Foreign Application Priority Data

Mar. 29, 2019 (KR) ..... 10-2019-0036766

(51) Int. Cl.
*H05B 45/345* (2020.01)
*H05B 45/44* (2020.01)
*H05B 45/59* (2022.01)

(52) U.S. Cl.
CPC ..... *H05B 45/345* (2020.01); *H05B 45/44* (2020.01); *H05B 45/59* (2022.01)

(58) Field of Classification Search
CPC ..... H05B 45/10; H05B 45/20; H05B 45/30; H05B 45/345; H05B 45/44; H05B 454/59; H05B 47/10
See application file for complete search history.

(56) References Cited

U.S. PATENT DOCUMENTS

2013/0049597 A1 2/2013 Pan
2014/0346959 A1 11/2014 Maiwald et al.
2016/0029447 A1 1/2016 Ido et al.

FOREIGN PATENT DOCUMENTS

CN 104902614 A * 9/2015 ..... H05B 33/0827
CN 108347801 A 7/2018
(Continued)

OTHER PUBLICATIONS

Extended European Search Report for counterpart Application No. PCT/KR2019018768, dated Mar. 23, 2022, 9 pages.
(Continued)

*Primary Examiner* — Jimmy T Vu
(74) *Attorney, Agent, or Firm* — Lewis Roca Rothgerber Christie LLP

(57) ABSTRACT

Disclosed is an AC source direct driving LED lighting device. The device including: a light emitting unit which has a first electrolytic capacitor and receives a rectified alternating current (AC) voltage to adjust a first constant current and emits an LED array; a charging/discharging unit which receives the adjusted first constant current to be adjusted to second to fourth constant currents and charges/discharges second to fourth electrolytic capacitors embedded therein, respectively; a discharge LED path unit which forms a path through which a voltage charged in the charging/discharging unit is discharged to the light emitting unit; and a current driving unit which receives the adjusted first to fourth constant currents to form first to fourth channel using first to fourth reference voltages and controls current transfer.

13 Claims, 6 Drawing Sheets

(56) References Cited

FOREIGN PATENT DOCUMENTS

| | | | | |
|---|---|---|---|---|
| JP | 2010-79377 | A | 4/2010 | |
| KR | 10-2013-0091461 | A | 8/2013 | |
| KR | 10-2016-0071827 | A | 6/2016 | |
| KR | 10-1757460 | B1 | 7/2017 | |
| KR | 10-2018-0071293 | A | 6/2018 | |
| KR | 20-2018-0002389 | U | 8/2018 | |
| WO | WO 2015/068978 | A1 | 5/2015 | |
| WO | WO-2015174877 | A2 * | 11/2015 | ..... H05B 33/083 |

OTHER PUBLICATIONS

International Search Report of PCT/KR2019/018768, dated Apr. 14, 2020, 4 pages.

* cited by examiner

ALTERNATING CURRENT SOURCE DIRECT DRIVING LED LIGHTING DEVICE

CROSS-REFERENCE TO RELATED APPLICATION

This application is a U.S. National Phase Patent Application of International Application Number PCT/KR2019/018768, filed on Dec. 31, 2019, which claims priority of Korean Patent Application Number 10-2019-0036766, filed on Mar. 29, 2019, the entire content of each of which is incorporated herein by reference.

BACKGROUND OF THE INVENTION

Field of the Invention

The present disclosure relates to an LED lighting device and particularly, to an alternating current (AC) source direct driving LED lighting device which enables a stable charging/discharging operation of an LED driving lighting device by minimizing the number of connection lines between a light emitting unit and a current driving unit and reducing the number of LED arrays in the light emitting unit without reducing power conversion efficiency.

Description of the Related Art

Generally, a light emitting diode (LED) is an optoelectronic device which has a bonding structure of P-type and N-type semiconductors and applies voltage to emit light with energy corresponding to a band gap of the semiconductor by binding of electrons and holes.

In particular, in the LED, the reaction time is, faster than a general bulb, and the power consumption is lowered at about 20% of a lighting device such as a conventional fluorescent lamp, and as a result, recently, the LED has been used in various aspects, including a high-efficiency lighting means.

A floodlighting using such an LED uses, as a light source, a module of assembling a plurality of high-luminance LEDs or power LEDs driven by an alternating current (AC) power source on a substrate.

In order to drive the LED from the AC source, a switching mode power supply (SMPS) was frequently used in the related art.

However, the structure switches high current to a high frequency so that the current flows through an inductor to generate electromagnetic waves and induce an electro-magnetic interference (EMI).

For this reason, the SMPS requires a predetermined filter circuit consisting of an input terminal and an inductor and a capacitor which are elements capable of storing energy between the LED and the switching unit, so as to prevent the generated high frequency power from being transmitted to an AC input stage wire.

Further, when the frequency of generated electromagnetic waves is gradually increasing, in some cases, since electric waves above a standard scale occur to be transmitted to a space, the electric waves are also shielded by using a metal case.

For this reason, the SMPS for driving the LED has problems that a circuit is complicated, a volume is increased, and manufacturing cost is increased.

Recently, in order to solve the problems, an AC voltage direct connection type LED driving circuit with a simple circuit and a low operation frequency is configured on the same PCB substrate as the LED to be frequently used as a low-price product.

However, the AC voltage direct connection type LED driving method still needs to improve many functions.

Generally, the AC voltage direct connection type LED driving device is configured by an AC source, a rectification unit, an LED, a switch element, and a current control resistor.

The control of power is performed by the current control resistor.

When the size of the current control resistor increases, the power decreases, and when the size of the current control resistor decreases, the power increases.

The switch element for configuring the AC voltage direct connection type LED driving device has three types of a serial type, a parallel type, and a current multiple type according to a connection method with the LED.

A first type switch element, a serial type switch element is connected in series to a negative (−) terminal of the LED array, and when the switch is On, the LED is lighted on and when the switch is Off, the LED is lighted off.

A second type switch element, a parallel type switch element is connected in parallel to both ends of the LED array, and when the switch is On, the LED is lighted off and when the switch is Off, the LED is lighted on.

While the AC voltage is lower than the voltage of a first LED array, the LED is lighted off.

While the AC voltage is higher than the voltage of the first LED array, the LED is lighted on.

When the AC voltage is higher than the sum of the voltages of the first and second LED arrays, the first and second LED arrays are lighted on.

The LED arrays are lighted on sequentially as the AC voltage is further increased.

As described above, there is a problem that when the serial and parallel type switch elements are disposed by the number of LED arrays in a general manner, the LED arrays are lighted on sequentially.

In order to solve the problems, when more switch elements than the number of LED arrays are appropriately added and disposed, in an AC voltage of the LED array voltage or more, all LED arrays may be simultaneously lighted on.

Such a simultaneous lighting method has a very good illuminance uniformity characteristic at the time of dimming.

Here, the uniformity characteristic means a uniformity ratio of luminance characteristic, and in the case of a conventional sequential lighting method other than the simultaneous lighting method, the uniformity is significantly lowered to 60% to 70% due to a deviation of lightings between the LED arrays.

In the simultaneous lighting method, there are a case of using only the parallel type switch element and a case of mixing and using the parallel and serial type switch elements.

However, in the case of using the series type switch element, even if the current control resistor is disposed at only one place, the switch element can be operated, but in the case of using the parallel type switch element, the current control resistor needs to be disposed for each switch element.

In order to solve the problem of disposing the current control resistors at many places in this way, there is a current multiple switch element, which is a third type switch element.

The current multiple switch element is an element which has a function of sensing when the current of the corresponding LED array flows to the series type switch element and allowing a desired multiple of current to flow from a positive (+) terminal of the corresponding LED array to a positive (+) terminal of the next LED array.

By using the current multiple switch element, the current may be branched to each LED array so as to be proportional to the current to be controlled in the series type switch element as a resistor disposed to control the current of the series type switch element.

However, when the AC voltage fluctuates or a voltage used by each country or region varies, there is a limit to newly design this device considering an actually used voltage.

Since two or more voltages are generally used for each country, two or more of products having different rated voltages are required.

The general range of the AC voltage for each country is 100 V to 277 V.

However, confoundingly, when installing a TRIAC dimmer with LEDs or an LED lighting device using a 0 to 10 V dimmer, electronic devices, electrical equipment, etc., there was a risk that safety problems such as overheating, destruction, and fire were caused by malfunction.

FIG. 1 is a circuit diagram of a 120 V alternating current (AC) source direct driving LED lighting device according to the related art, which includes an AC source 10, a rectification unit 20, first to fourth light emitting units 30 to 60, and a current driving unit 70.

The first light emitting unit 30 includes a first LED array LA1, a first electrolytic capacitor EC1, a first discharge resistor RC1, and the second light emitting unit 40 includes a second LED array LA2, a second electrolytic capacitor EC2, and a second discharge resistor RC2.

Further, the third light emitting unit 50 includes a third LED array LA3, a third electrolytic capacitor EC3, and a third discharge resistor RC3, and the fourth light emitting unit 60 includes a fourth LED array LA4, a fourth electrolytic capacitor EC4 and a fourth discharge resistor RC4.

FIG. 2 is a graph showing waveforms as a result of simulating an input current of the LED lighting device illustrated in FIG. 1 and currents flowing in the first to third LED arrays LA1 to LA3.

FIG. 3 is a graph showing waveforms as a result of simulating an input current in the LED lighting device illustrated in FIG. 1, a current flowing in the first LED array LA1, and a current flowing in a first channel CH1.

Referring to FIGS. 1 to 3, an operation of the 120 V AC source direct driving LED lighting device according to the related art will be schematically described as follows.

Since the AC voltage direct connection type LED driving device is a linear type, power efficiency depends on a ratio of pitch values of an entire serial voltage and a AC source voltage of the LED.

Usually, the entire serial voltage of the LED is used to be set to about 80% voltage of the AC source voltage.

In addition, in order to increase light efficiency and improve electrical characteristics such as a power factor, an integrated circuit (IC) for implementing this has been usually used by four channels.

In this case, in intermediate terminals of the serially connected LEDs, three connection lines are made to operate by connecting a total of four terminals including a negative [−] terminal of the LED which is the last terminal to the channels of the integrated circuit.

That is, as illustrated in FIG. 1, when a rectified AC voltage |VAC| is applied to the four light emitting units 30 to 60, four channels CH1, CH2, CH3, and CH4 are formed through first to fourth field effect transistors Q1 to Q4.

To drive the four channels CH1, CH2, CH3, and CH4, output terminals of first to fourth comparators in which reference voltages REF1, REF2, REF3, and REF4 are gradually increased are connected to gate terminals of the first to fourth field effect transistors Q1, Q2, Q3, and Q4, respectively.

The electrolytic capacitor EC1 is connected in parallel to the LED array LA1 for a flicker reduction of the LED array LA1, and the electrolytic capacitors EC2, EC3, and EC4 are connected in parallel to the LED arrays LA2, LA3, and LA4 to replace the LED arrays LA2, LA3, and LA4, respectively.

Resistors RC1, RC2, RC3, and RC4 become discharge resistors which are discharge paths together with the capacitors EC1, EC2, EC3, and EC4 when the AC source is shut off.

Diodes D1, D2, D3, and D4 electrically isolate four parallel-connected light emitting units 30 to 60 from each other.

In the current control resistor RS, one side is connected to a source terminal of each of the first to fourth field effect transistors Q1, Q2, Q3, and Q4 and the other side is grounded to control a source current of the first to fourth field effect transistors Q1, Q2, Q3, and Q4.

However, in this way, a total of five connection lines including a LED [+] terminal are required to separately drive the light emitting units 30 to 60 including the LEDs and the current driving unit 70.

Also, in the case of connecting the capacitors with the LEDs in parallel to improve a flicker characteristic, since each of the LED arrays LA1, LA2, LA3, and LA4 needs to be electrically separated from the diode, there were problems that total eight connection lines are required to increase a volume and a position relation of the connection lines is complicated, so that it is difficult to assemble components.

Therefore, in this aspect, in order to decrease the volume and facilitate the component assembling in the power supply device of the LED driving lighting device, it is preferred to minimize the number of connection lines between the light emitting units 30 to 60 and the current driving unit 70.

Meanwhile, in a conventional AC source direct driving LED lighting device, as illustrated in FIG. 3, as four LED arrays LA1, LA2, LA3, and LA4 are configured, an input current variation step is formed by four steps.

Further, it can be seen that the LED current is distributed for each array of three 36 V LED arrays LA1, LA2, and LA3 to have a difference in current level of each array, but is lower than the input current.

The total LED power is a value of summing the product of the voltage of each of the LED arrays LA1, LA2, LA3, and LA4 and the current of each of the LED arrays LA1, LA2, LA3, and LA4, wherein it can be seen that the current of the first channel CH1 is lower than the currents of the three LED arrays LA1, LA2, and LA3.

As a result, there was a problem that during discharging through the path of the first channel CH1, an operation of the second to fourth electrolyte capacitors EC2, EC3, and EC4 in which charges which have been charged need to be discharged at a short time is not normally performed.

The above-described technical configuration is the background art for helping in the understanding of the present invention, and does not mean a conventional technology widely known in the art to which the present invention pertains.

SUMMARY OF THE INVENTION

An object of the present disclosure is to provide an AC source direct driving LED lighting device capable of minimizing the number of connection lines between a light emitting unit and a current driving unit to decrease the volume of a power supply device of the LED driving lighting device and facilitate the component assembling.

Further, another object of the present disclosure is to provide an AC source direct driving LED lighting device capable of stably performing a charging/discharging operation of the LED driving lighting device by decreasing the number of LED arrays in the light emitting unit without reduction of power conversion efficiency.

An AC source direct driving LED lighting device of the present disclosure for achieving the objects includes: a light emitting unit which has a first electrolytic capacitor and receives a rectified AC voltage to adjust a first constant current and emits LED arrays; a charging/discharging unit which receives the adjusted first constant current to be adjusted to second to fourth constant currents and charges/discharges embedded second to fourth electrolytic capacitors, respectively; a discharge LED path unit which forms a path of discharging the voltage charged in the charging/discharging unit to the light emitting unit; and a current driving unit which receives the adjusted first to fourth constant currents to form first to fourth channels using first to fourth reference voltages and controls current transfer.

The charging/discharging unit may include a first charging/discharging unit which receives the adjusted first constant current to be adjusted to the second constant current and charges/discharges the second electrolytic capacitor; {>a second charging/discharging unit which receives the adjusted second constant current to be adjusted to the third constant current and charges/discharges the third electrolytic capacitor; and a third charging/discharging unit which receives the adjusted third constant current to be adjusted to the fourth constant current and charges/discharges the fourth electrolytic capacitor.

The AC source direct driving LED lighting device may further include a rectification unit which receives and rectifies an AC voltage from an AC source to output the rectified AC voltage; and first to fourth isolation diodes which electrically isolate the light emitting unit and the first to third charging/discharging units which are connected in parallel, from each other.

The light emitting unit may include the first electrolytic capacitor of which one side is connected to a cathode terminal of the first isolation diode and the other side is connected to an anode terminal of the second isolation diode to charge a first charge; a first discharge resistor which is connected to the first electrolytic capacitor in parallel to discharge the charged first charge; and the LED array which includes a plurality of LEDs, is connected to the first electrolytic capacitor in parallel, and receives a rectified AC voltage passing through the first isolation diode to emit light.

The first charging/discharging unit may include the second electrolytic capacitor of which one side is connected to a cathode terminal of the second isolation diode to charge a second charge; and a second discharge resistor which is connected to the second electrolytic capacitor in parallel to discharge the charged second charge.

The second charging/discharging unit may include the third electrolytic capacitor of which one side is connected to a cathode terminal of the third isolation diode to charge a third charge; and a third discharge resistor which is connected to the third electrolytic capacitor in parallel to discharge the charged third charge.

The third charging/discharging unit may include the fourth electrolytic capacitor of which one side is connected to a cathode terminal of the fourth isolation diode to charge a fourth charge; and a fourth discharge resistor which is connected to the fourth electrolytic capacitor in parallel to discharge the charged fourth charge.

The AC source direct driving LED lighting device may further include {>a reference voltage generation unit which generates and outputs the first to fourth reference voltages that are gradually increasing; a channel isolation unit which isolates the second to fourth channels from the charging/discharging unit when discharging the charging/discharging unit; and a discharge capacitor path unit which forms a discharge path to the first channel from the second to fourth electrolytic capacitors when the second to fourth channels are isolated.

The channel isolation unit may include a first channel isolation diode of which an anode terminal is connected to the other side of the second electrolytic capacitor and a cathode terminal is connected to an input terminal of the current driving unit to be electrically isolated from the second channel when discharging the second electrolytic capacitor; a second channel isolation diode of which an anode terminal is connected to the other side of the third electrolytic capacitor and a cathode terminal is connected to an input terminal of the current driving unit to be electrically isolated from the third channel when discharging the third electrolytic capacitor; and a third channel isolation diode of which an anode terminal is connected to the other side of the fourth electrolytic capacitor and a cathode terminal is connected to an input terminal of the current driving unit to be electrically isolated from the fourth channel when discharging the fourth electrolytic capacitor.

The discharge capacitor path unit may include a first discharge path diode of which a cathode terminal is connected to the other side of the second electrolytic capacitor and an anode terminal is connected to an output terminal of the current driving unit to form a discharge path to the first channel from the second electrolytic capacitor when the second to fourth channels are isolated; a second discharge path diode of which a cathode terminal is connected to the other side of the third electrolytic capacitor and an anode terminal is connected to an output terminal of the current driving unit to form a discharge path to the first channel from the third electrolytic capacitor when the second to fourth channels are isolated; and a third discharge path diode of which a cathode terminal is connected to the other side of the fourth electrolytic capacitor and an anode terminal is connected to an output terminal of the current driving unit to form a discharge path to the first channel from the fourth electrolytic capacitor when the second to fourth channels are isolated.

The discharge LED path unit may include a first diode of which an anode terminal is connected to one side of the second electrolytic capacitor and a cathode terminal is connected to the light emitting unit to form a path of discharging the voltage, which has been charged in the second electrolytic capacitor, to the light emitting unit; a second diode of which an anode terminal is connected to one side of the third electrolytic capacitor and a cathode terminal is connected to the light emitting unit to form a path of discharging the voltage, which has been charged in the third electrolytic capacitor, to the light emitting unit; and a third diode of which an anode terminal is connected to one side of the fourth electrolytic capacitor and a cathode terminal is connected to the light emitting unit to form a path of discharging the voltage, which has been charged in the fourth electrolytic capacitor, to the light emitting unit.

The current driving unit may include a first channel current driving unit which receives the adjusted first constant current from the light emitting unit through a first transistor to control the driving of the current of the first channel according to an opening/closing of the first transistor depending on the control of a first comparator; a second channel current driving unit which receives the current from the first channel isolation diode through a second transistor to control the driving of the current of the second channel according to an opening/closing of the second transistor depending on the control of a second comparator; a third channel current driving unit which receives the current from the second channel isolation diode through a third transistor to control the driving of the current of the third channel according to an opening/closing of the third transistor depending on the control of a third comparator; and a fourth channel current driving unit which receives the current from the third channel isolation diode through a fourth transistor to control the driving of the current of the fourth channel according to an opening/closing of the fourth transistor depending on the control of a fourth comparator.

An AC source direct driving LED lighting device of the present disclosure for achieving the objects includes: a light emitting unit which has a first electrolytic capacitor and receives a rectified AC voltage to adjust a first constant current and emits LED arrays; a charging/discharging unit which receives the adjusted first constant current to be adjusted to second to fourth constant currents and charges/discharges embedded second to fourth electrolytic capacitors, respectively; a discharge LED path unit which forms a path of discharging the voltage charged in the charging/discharging unit to the light emitting unit; and a current driving unit which receives the adjusted first to fourth constant currents to form first to fourth channels using first to fourth reference voltages and controls current transfer, wherein an operation of being charged in the second to fourth electrolytic capacitors when the rectified AC current is applied and an operation of being discharged through the light emitting unit when the rectified AC current is applied lower than the voltages of the light emitting unit and the charging/discharging unit are repeated.

The specific details of other embodiments are included in the "the detailed description of the invention" and the accompanying "drawings".

Advantages and/or features of the present disclosure, and methods for achieving the advantages and/or features will be apparent with reference to embodiments to be described below in detail together with the accompanying drawings.

However, the present disclosure is not limited only to a configuration of each embodiment to be disclosed below, but may also be implemented in various different forms. The respective embodiments disclosed in this specification are provided only to complete disclosure of the present disclosure and to fully provide those skilled in the art to which the present disclosure pertains with the category of the invention, and the present disclosure will be defined only by the scope of each claim of the claims.

According to the present disclosure, there is no need to switch a high current at a high frequency so that a current flows through an inductor, and as a result, as an electromagnetic wave interference phenomenon is prevented, a filter circuit for filtering the high frequency becomes unnecessary.

Further, since a deviation of the lighting-on between LED arrays is removed as compared to the conventional sequential lighting method, the uniformity of the LED lighting is remarkably improved.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
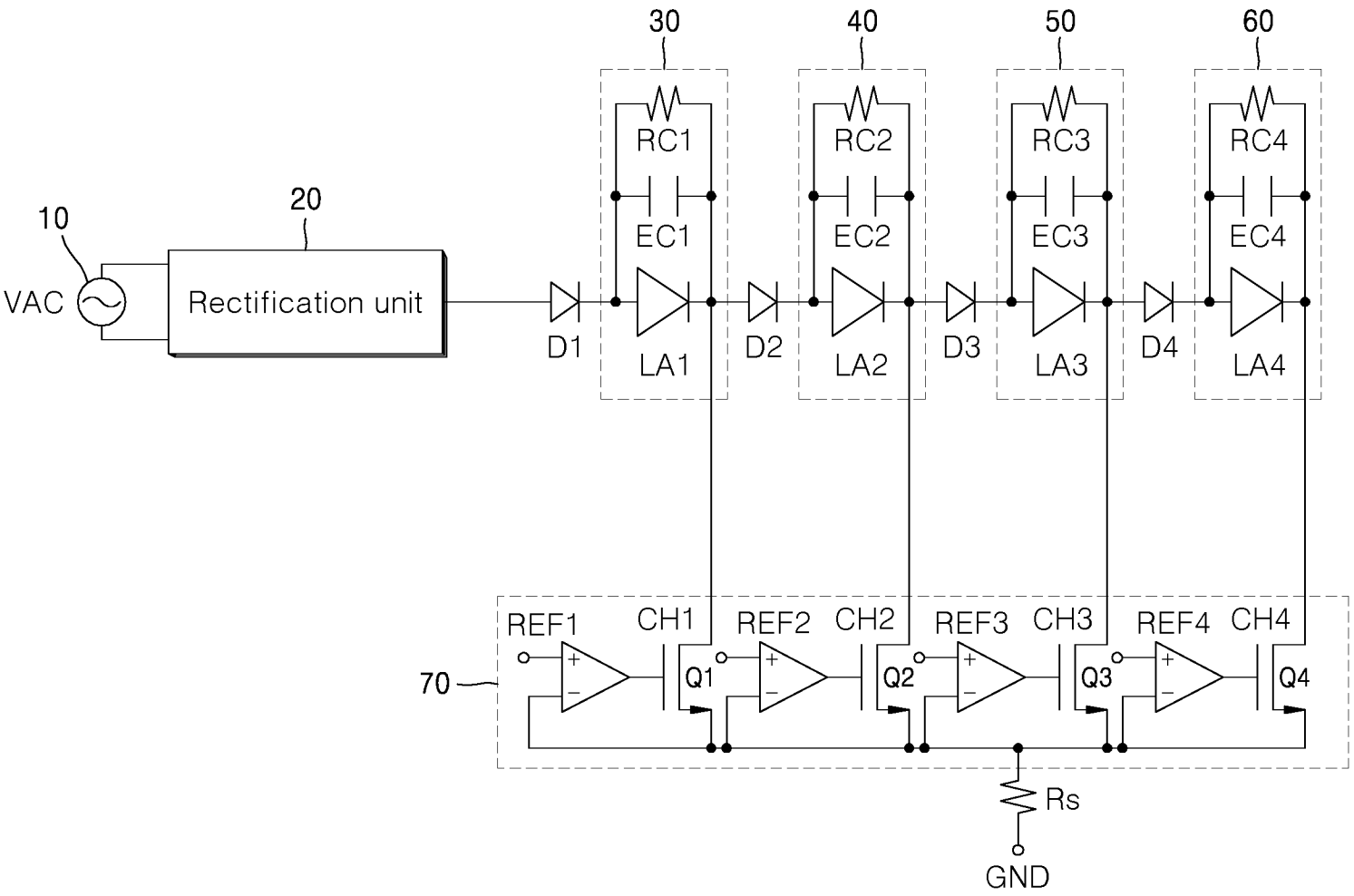
FIG. 1 (PRIOR ART)
FIG. 1 is a circuit diagram of a 120 V AC source direct driving LED lighting device according to the related art.
Figure 2:
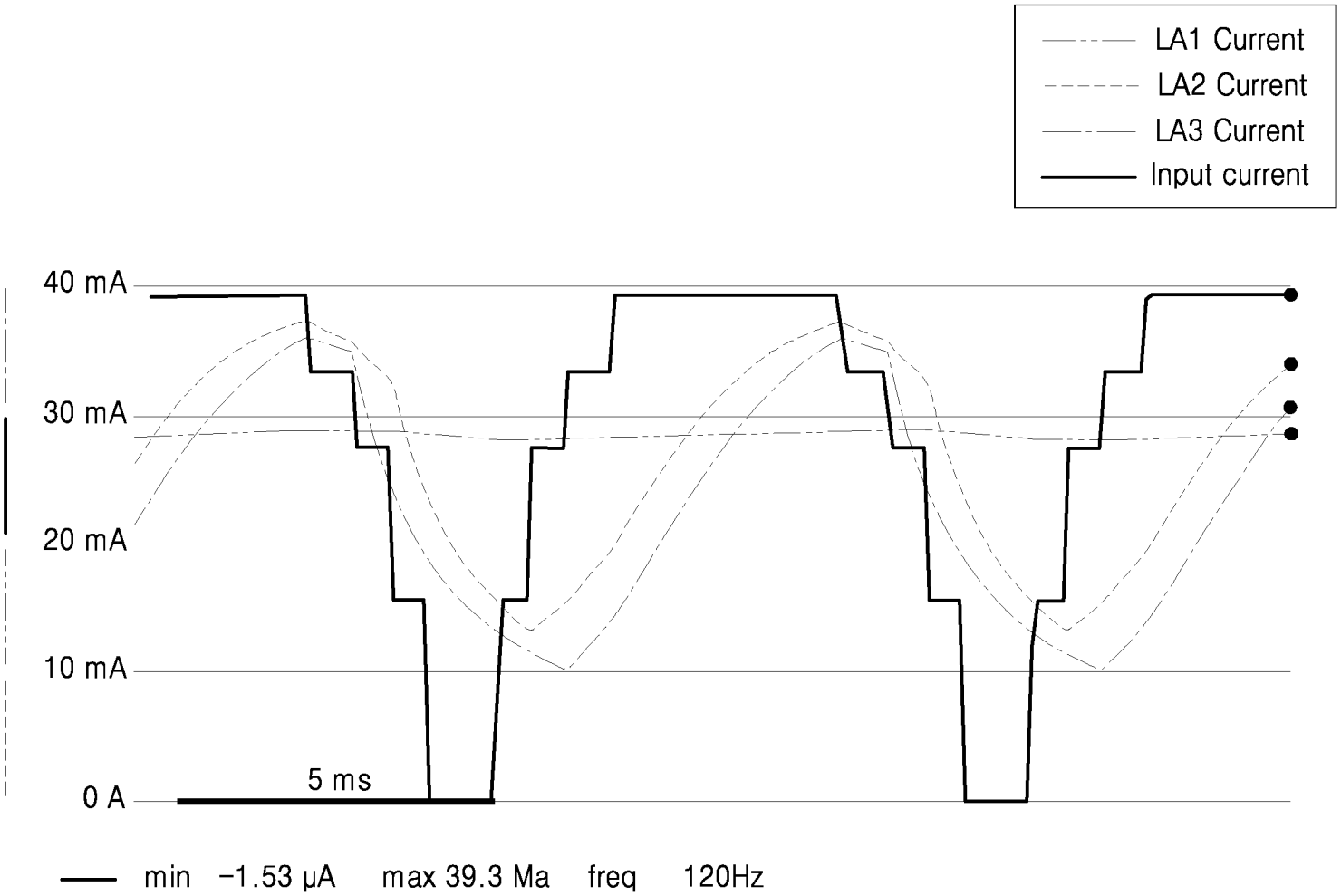
FIG. 2 (PRIOR ART)
FIG. 2 is a graph showing waveforms as a result of simulating an input current of the LED lighting device illustrated in FIG. 1 and currents flowing in first to third LED arrays LA1 to LA3.

Hereinafter, preferred embodiments of the present disclosure will be described below in detail with reference to the accompanying drawings.

Before describing the present disclosure in detail, the terms or words used herein should not be constructed to be unconditionally limited by conventional or dictionary meanings, and in order to explain the present disclosure of the present inventors by the best method, the concepts of various terms can be appropriately defined and used.

Furthermore, it should be noted that these terms or words should be interpreted as meanings and concepts according to the technical ideas of the present disclosure.

That is, the terms used herein are used to describe preferred embodiments of the present disclosure, but are not used so as to specifically limit the contents of the present disclosure.

It should be noted that these terms are defined in consideration of various possibilities of the present disclosure.

Further, in this specification, the singular expression may include a plural expression, unless otherwise indicated in the context clearly.

Similarly, it should be noted that even if the plural expression is made, a single meaning may be included.

Throughout this specification, when a component is described as "including" the other component, the component does not exclude any other component, but may further include any other component unless otherwise indicated in contrary.

Furthermore, if it is described that a component is "present inside, or connected and installed with" the other component, the component may be directly connected or contacted and installed with the other component.

Further, a component may also be installed to be spaced apart from the other component at a constant distance, and when the component is installed to be spaced apart from the other component with a constant distance, a third component or mean may be present to fix and connect the corresponding component to the other component.

Meanwhile, it should be noted that the description of the third component or means may also be omitted.

On the contrary, when it is described that a component is "directly connected to" or "directly accesses" the other component, it should be understood that a third component or means does not exist.

Similarly, other expressions describing a relationship between components, that is, expressions such as "between" and "directly between" or "adjacent to" and "directly adjacent to" should be similarly interpreted.

In addition, in the specification, the terms such as "one surface", "the other surface", "one side", "the other side", "first", "second", etc., are used to clearly distinguish one component from the other component with respect to one component.

However, it should be noted that the meaning of the corresponding component is not limited by these terms.

In addition, in this specification, when the terms related to locations such as "upper", "lower", "left", and "right" are used, it should be understood that the corresponding component represents a relative position in the corresponding drawing.

In addition, it is not understood that so long as an absolute location is not specified for these locations, the terms related to these locations refer to an absolute location.

Furthermore, in the specification of the present disclosure, if the terms such as "unit", "er", "module", and "device" are used, the terms mean a unit capable of processing one or more functions or operations.

It should be noted that the present disclosure may be implemented by hardware or software, or a combination of hardware or software.

In the drawings appended to this specification, a size, a location, a coupling relationship, etc. of each component constituting the present disclosure may be described while being partially exaggerated, reduced, or omitted for sufficiently clearly delivering the spirit of the present disclosure or for the convenience of description, and thus, the proportion or scale thereof may not be exact.

Further, hereinafter, in the following description of the present disclosure, a detailed description of a configuration determined to unnecessarily obscure the subject matter of the present disclosure, for example, a known technology including the related art may also be omitted.

Figure 4:
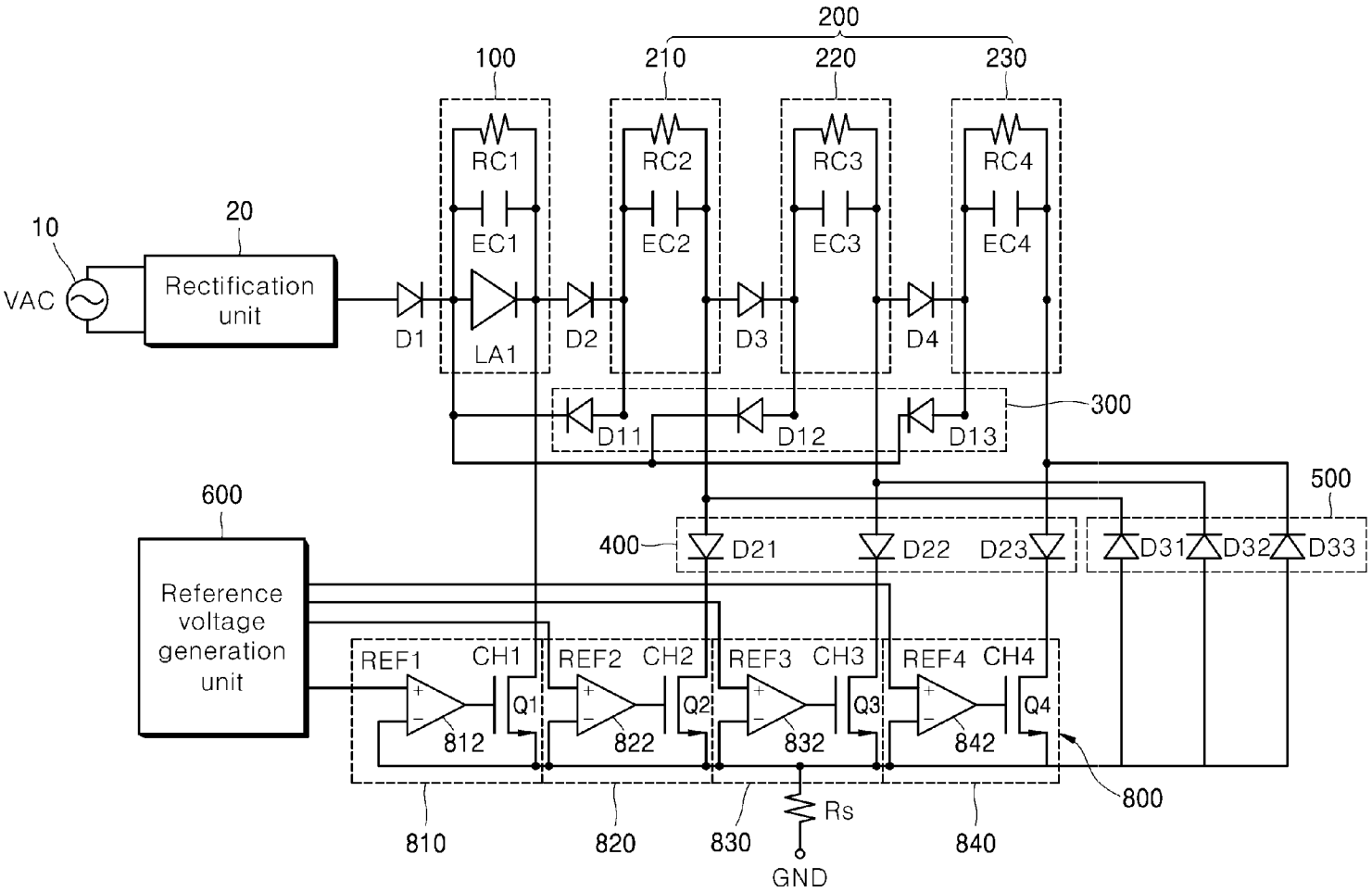
FIG. 4 is a circuit diagram of a 120 V AC source direct driving LED lighting device according to the present disclosure.

FIG. 4 is a circuit diagram of a 120 V AC source direct driving LED lighting device according to the present disclosure. The AC source direct driving LED lighting device includes an AC source 10, a rectification unit 20, a light emitting unit 100, a charging/discharging unit 200, first to fourth isolation diodes D1 to D4, a discharge LED path unit 300, a channel isolation unit 400, a discharge capacitor path unit 500, a reference voltage generation unit 600, a current driving unit 800, and a current control resistor RS.

The light emitting unit 100 includes an LED array LA1, a first electrolytic capacitor EC1, and a first discharge resistor RC1, and the charging/discharging unit 200 includes first to third charging/discharging units 210, 220, and 230.

The first charging/discharging unit 210 includes a second electrolytic capacitor EC2 and a second discharge resistor RC2, the second charging/discharging unit 220 includes a third electrolytic capacitor EC3 and a third discharge resistor RC3, and the third charging/discharging unit 230 includes a fourth electrolytic capacitor EC4 and a fourth discharge resistor RC4.

The current driving unit 800 includes first to fourth channel current driving units 810 to 840.

The first channel current driving unit 810 includes a first comparator 812 and a first transistor Q1, the second channel current driving unit 820 includes a second comparator 822 and a second transistor Q2, the third channel current driving unit 830 includes a third comparator 832 and a third transistor Q3, and the fourth channel current driving unit 840 includes a fourth comparator 842 and a fourth transistor Q4.

Figure 5:
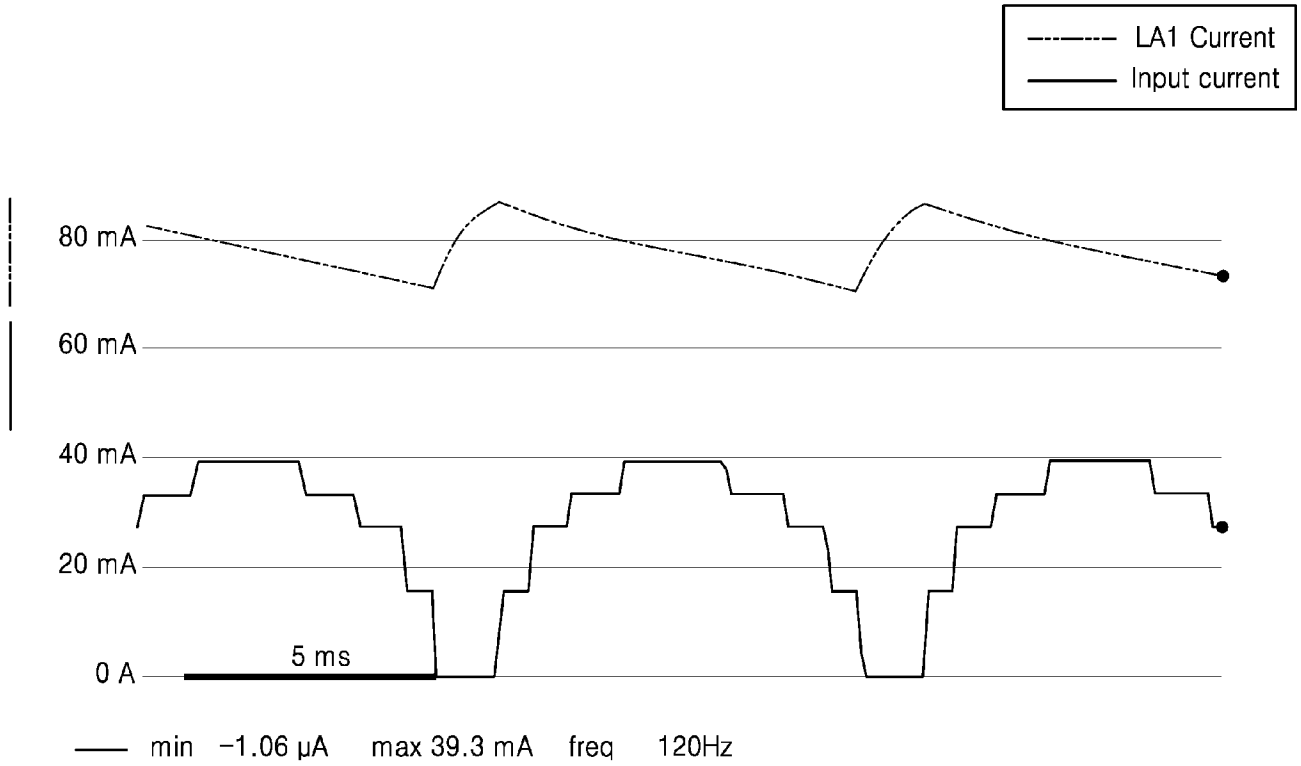
FIG. 5 is a graph showing waveforms as a result of simulating an input current of the LED lighting device illustrated in FIG. 4 and a current flowing in a first LED array LA1.

FIG. 5 is a graph showing waveforms as a result of simulating an input current of the LED lighting device illustrated in FIG. 4 and a current flowing in a first LED array LA1.

Figure 6:
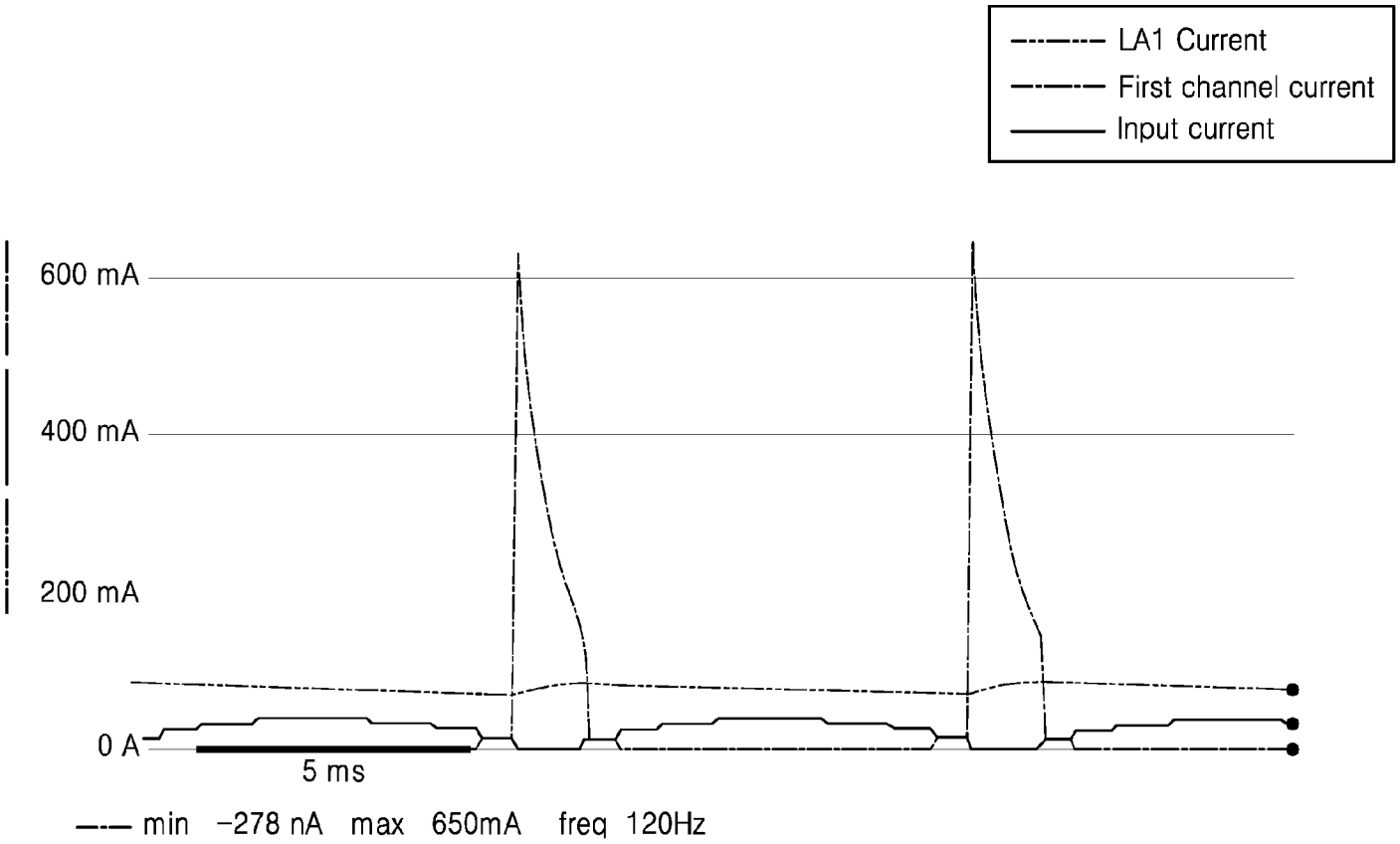
FIG. 6 is a graph showing waveforms as a result of simulating an input current in the LED lighting device illustrated in FIG. 4, a current flowing in the first LED array LA1, and a current flowing in a first channel CH1.

FIG. 6 is a graph showing waveforms as a result of simulating the input current in the LED lighting device illustrated in FIG. 4, the current flowing in the first LED array LA1, and a current flowing in a first channel CH1.

Referring to FIGS. 4 to 6, the structure and functions of each component of the AC source direct driving LED lighting device according to the present disclosure will be schematically described below.

The rectification unit 20 receives and rectifies an AC voltage from the AC source 10 to output a rectified AC voltage |VAC|.

The light emitting unit 100 receives the rectified AC voltage |VAC| from the rectification unit 20 and adjusts a first constant current to emit the LED array LA1.

That is, the constant current is adjusted by the charge/discharge operation of the first electrolytic capacitor EC1 embedded in the light emitting unit 100 to emit the LED array LA1 connected in parallel with the first electrolytic capacitor EC1.

The charging/discharging unit 200 receives the adjusted first constant current from the light emitting unit 100 to be adjusted to the second to fourth constant currents and charges/discharges the second to fourth electrolytic capacitors EC2, EC3, and EC4 embedded therein, respectively.

At this time, the LED array LA1 stabilizes a driving operation of the AC source direct driving LED lighting device by a stable charging/discharging operation of the first to fourth electrolytic capacitors EC1, EC2, EC3, and EC4 embedded in the light emitting unit 100 and the first to third charging/discharging units 210, 220, and 230, respectively.

The first to fourth discharge resisters RC1, RC2, RC3, and RC4 embedded in the light emitting unit 100 and the charging/discharging unit 200 become discharge paths together with the first to fourth electrolytic capacitors EC1, EC2, EC3, and EC4 when the AC power is shut off the AC source 10.

The first to fourth isolation diodes D1, D2, D3, and D4 electrically isolate the light emitting unit 100 and the first to third charging/discharging units 210, 220, and 230, which are connected to each other in parallel, from each other, respectively The first to third diodes D11, D12, and D13 in the discharge LED path unit 300 form paths of discharging the voltages which have been charged in the second to fourth electrolytic capacitors EC2, EC3, and EC4 by parallel connection of the first LED array LA1 and the first electrolytic capacitor EC1 in the light emitting unit 100.

The first to third channel isolation diodes D21, D22, and D23 in the channel isolation unit 400 form paths through which the current flows through the second to fourth channels CH2, CH3, and CH4 and electrically isolate the second to fourth electrolytic capacitors EC2, EC3, and EC4 from the second to fourth channels CH2, CH3, and CH4 when discharging the second to fourth electrolytic capacitors EC2, EC3, and EC4, respectively, to prevent the flow of a reverse current in the second to fourth channels CH2, CH3, and CH4.

The first to third discharge path diodes D31, D32, and D33 in the discharge capacitor path unit 500 form discharge paths from the second to fourth electrolytic capacitors EC2, EC3, and EC4 to the first channel CH1 when the second to fourth channels CH2, CH3, and CH4 are isolated.

The current driving unit 800 receives the first to fourth constant currents adjusted from the light emitting unit 100 and the charging/discharging unit 200, respectively, to form four channels CH1, CH2, CH3, and CH4 through a turn-on operation of the embedded first to fourth field effect transistors Q1 to Q4 and controls the current transfer according to an opening/closing operation.

One side of the current control resistor RS is commonly connected to a source terminal of the first to fourth field effect transistors Q1 to Q4 and the other side thereof is grounded to control the current amount of the current driving unit 800.

The reference voltage generation unit 600 generates and outputs first to fourth reference voltages REF1, REF2, REF3, and REF4 which gradually increase.

At this time, in a gate terminal of each of the first to fourth field effect transistors Q1 to Q4, the first to fourth reference voltages REF1, REF2, REF3, and REF4 are connected to output terminals of the first to fourth comparators 810 to 840, respectively, so that the first to fourth field effect transistors Q1 to Q4 are turned on.

That is, when the first to fourth reference voltages REF1, REF2, REF3, and REF4 are larger than a terminal voltage of the current control resistor RS, the first to fourth comparators 810 to 840 output '1', so that the first to fourth field effect transistors Q1 to Q4 are turned on.

Referring to FIGS. 4 to 6, the structure and functions of each component of the light emitting unit 100 in the LED lighting device for preventing a flicker according to the present disclosure will be described below in detail.

One side of the first electrolytic capacitor EC1 is connected to a cathode terminal of the first isolation diode D1 and the other side thereof is connected to an anode terminal of the second isolation diode D2 to charge a first charge.

The first discharge resistor RC1 is connected to the first electrolytic capacitor EC1 in parallel to discharge the charged first charge.

The LED array LA1 includes a plurality of LEDs (not illustrated) and receives the rectified AC voltage |VAC| from the rectification unit 20 to emit light.

Referring to FIGS. 4 to 6, the structure and functions of each component of the first to third charging/discharging units 210 to 230 in the LED lighting device for preventing a flicker according to the present disclosure will be described below in detail.

One side of the second electrolytic capacitor EC2 is connected to a cathode terminal of the second isolation diode D2 to charge a second charge.

The second discharge resistor RC2 is connected to the second electrolytic capacitor EC2 in parallel to discharge the charged second charge.

One side of the third electrolytic capacitor EC3 is connected to a cathode terminal of the third isolation diode D3 to charge a third charge.

The third discharge resistor RC3 is connected to the third electrolytic capacitor EC3 in parallel to discharge the charged third charge.

One side of the fourth electrolytic capacitor EC4 is connected to a cathode terminal of the fourth isolation diode D4 to charge a fourth charge.

The fourth discharge resistor RC4 is connected to the fourth electrolytic capacitor EC4 in parallel to discharge the charged fourth charge.

Referring to FIGS. 4 to 6, the structure and functions of each component of the discharge LED path unit 300 in the LED lighting device for preventing the flicker according to the present disclosure will be described below in detail.

The first diode D11 has an anode terminal connected to one side of the second electrolytic capacitor EC2 and a cathode terminal connected to the light emitting unit 100 to form a path of discharging the voltage, which has been charged in the second electrolytic capacitor EC2, by parallel connection of the first LED array LA1 and the first electrolytic capacitor EC1 in the light emitting unit 100.

The second diode D12 has an anode terminal connected to one side of the third electrolytic capacitor EC3 and a cathode terminal connected to the light emitting unit 100 to form a path of discharging the voltage, which has been charged in the third electrolytic capacitor EC3, by parallel connection of the first LED array LA1 and the first electrolytic capacitor EC1 in the light emitting unit 100.

The third diode D13 has an anode terminal connected to one side of the fourth electrolytic capacitor EC4 and a cathode terminal connected to the light emitting unit 100 to form a path of discharging the voltage, which has been charged in the fourth electrolytic capacitor EC4, by parallel connection of the first LED array LA1 and the first electrolytic capacitor EC1 in the light emitting unit 100.

Referring to FIGS. 4 to 6, the structure and functions of each component of the channel isolation unit 400 in the LED lighting device for preventing the flicker according to the present disclosure will be described below in detail.

The first channel isolation diode D21 has an anode terminal connected to the other side of the second electrolytic capacitor EC2 and a cathode terminal connected to an input terminal of the current driving unit 800 to electrically isolate the second electrolytic capacitor EC2 from the second channel CH2 when discharging the second electrolytic capacitor EC2, thereby preventing the flow of a reverse current of the second channel CH2.

The second channel isolation diode D22 has an anode terminal connected to the other side of the third electrolytic capacitor EC3 and a cathode terminal connected to an input terminal of the current driving unit 800 to electrically isolate the third electrolytic capacitor EC3 from the third channel CH3 when discharging the third electrolytic capacitor EC3, thereby preventing the flow of a reverse current of the third channel CH3.

The third channel isolation diode D23 has an anode terminal connected to the other side of the fourth electrolytic capacitor EC4 and a cathode terminal connected to an input terminal of the current driving unit 800 to electrically isolate the fourth electrolytic capacitor EC4 from the fourth channel CH4 when discharging the fourth electrolytic capacitor EC4, thereby preventing the flow of a reverse current of the fourth channel CH4.

Referring to FIGS. 4 to 6, the structure and functions of each component of the discharge capacitor path unit 500 in the LED lighting device for preventing the flicker according to the present disclosure will be described below in detail.

The first discharge path diode D31 has a cathode terminal connected to the other side of the second electrolytic capacitor EC2 and an anode terminal connected to an output terminal of the current driving unit 800 to form a discharge path to the first channel CH1 from the second electrolytic capacitor EC2 when the second to fourth channels CH2, CH3, and CH4 have been isolated.

The second discharge path diode D32 has a cathode terminal connected to the other side of the third electrolytic capacitor EC3 and an anode terminal connected to an output terminal of the current driving unit 800 to form a discharge path to the first channel CH1 from the third electrolytic capacitor EC3 when the second to fourth channels CH2, CH3, and CH4 have been isolated.

The third discharge path diode D33 has a cathode terminal connected to the other side of the fourth electrolytic capacitor EC4 and an anode terminal connected to an output terminal of the current driving unit 800 to form a discharge path to the first channel CH1 from the fourth electrolytic capacitor EC4 when the second to fourth channels CH2, CH3, and CH4 have been isolated.

Referring to FIGS. 4 to 6, the structure and functions of each component of the current driving unit 800 in the LED lighting device for preventing the flicker according to the present disclosure will be described below in detail.

The first channel current driving unit 810 receives the adjusted first constant current from the light emitting unit 100 to control the driving of the current of the first channel CH1 according to an opening/closing of the first transistor Q1 depending on the control of the first comparator 812.

The second channel current driving unit 820 receives a current from the first channel isolation diode D21 in the channel isolation unit 400 to control the driving of the current of the second channel CH2 according to an opening/closing of the second transistor Q2 depending on the control of the second comparator 822.

The third channel current driving unit 830 receives a current from the second channel isolation diode D22 in the channel isolation unit 400 to control the driving of the current of the third channel CH3 according to an opening/closing of the third transistor Q3 depending on the control of the third comparator 832.

The fourth channel current driving unit 840 receives a current from the third channel isolation diode D23 in the channel isolation unit 400 to control the driving of the current of the fourth channel CH4 according to an opening/closing of the fourth transistor Q4 depending on the control of the fourth comparator 842.

Referring to FIGS. 4 to 6, an operation of the AC source direct driving LED lighting device according to an embodiment of the present disclosure will be described below in detail.

The LED lighting device of the present disclosure stabilizes a driving operation of the AC source direct driving LED lighting device by the following stabilized charging and discharging operation through an intermediate operation in which the AC power is applied to charge an electrolytic capacitor ECj (j=1 to 4).

That is, when the rectified AC voltage is applied from the AC source 10, the current flows through the second to fourth channels CH2, CH3, and CH4 of the integrated circuit to be charged in the second to fourth electrolytic capacitors EC2, EC3, and EC4, respectively.

In addition, when the applied AC voltage is lower than the voltage of any one of the second to fourth electrolytic capacitors EC2, EC3, and EC4 connected with the positive (+) terminal of the first LED array LA1 through the second to fourth diodes D2, D3, and D4, the electrolytic capacitors charged with a voltage higher than the voltage of the first LED array LA1 are discharged through the first LED array LA1 and the first electrolytic capacitor EC1 connected therewith in parallel.

At this time, the discharging of the second electrolytic capacitor EC2 occurs through a path of the first discharge path diode D31 in the discharge capacitor path unit 500-the second electrolytic capacitor EC2-the first diode D11 in the discharge LED path unit 300-(parallel connection of the first LED array LA1 and the first electrolytic capacitor EC1)-the first channel CH1-the first discharge path diode D31 in the discharge capacitor path unit 500.

The discharging of the third electrolytic capacitor EC3 occurs through a path of the second discharge path diode D32 in the discharge capacitor path unit 500-the third electrolytic capacitor EC3-the second diode D12 in the discharge LED path unit 300-(parallel connection of the first LED array LA1 and the first electrolytic capacitor EC1)-the first channel CH1-the second discharge path diode D32 in the discharge capacitor path unit 500.

The discharging of the fourth electrolytic capacitor EC4 occurs through a path of the third discharge path diode D33 in the discharge capacitor path unit 500-the fourth electrolytic capacitor EC4-the third diode D13 in the discharge LED path unit 300-(parallel connection of the first LED array LA1 and the first electrolytic capacitor EC1)-the first channel CH1-the third discharge path diode D33 in the discharge capacitor path unit 500.

Accordingly, all of the second to fourth electrolytic capacitors EC2, EC3, and EC4 are discharged while being parallel-connected with the first LED array LA1 to be equal to the voltage of the first LED array LA1.

Thereafter, when the applied AC voltage is increased to be higher than the voltage of the first LED array LA1, the current flows through the first channel CH1, and when the applied AC voltage is twice larger than the voltage of the first LED array LA1, the current flows through the second channel CH2.

The second electrolytic capacitor EC2 causes a voltage increase as the following Equation while the current flows.

(Increased voltage of second electrolytic capacitor EC2 by current of second channel CH2)=(Current of second channel CH2)×(Turn-on time of second channel CH2)/(Capacitance of second electrolytic capacitor EC2) [Equation 1]

Further, when the applied AC voltage is increased to become 3×(voltage of first LED array LA1)+(increased voltage of second electrolytic capacitor EC2 by current of second channel CH2) or more, the current flows to the third channel CH3, and at this time, both the second electrolytic capacitor EC2 and the third electrolytic capacitor EC3 are more increased in voltage than before.

Similarly, since the voltage is lowered after the current flows to the fourth channel CH4 through the fourth electrolytic capacitor EC4, the voltage of the electrolytic capacitor is increased while the current flows again in the order of the third channel CH3, the second channel CH2, and the first channel CH1.

However, the discharging of the second to fourth electrolytic capacitors EC2, EC3, and EC4 occurs again through the process to perform a stable operation by repeating an operation in which the voltage of the second to fourth electrolytic capacitors EC2, EC3, and EC4 is the same as the voltage of the first LED array LA1.

Accordingly, the degree in which the voltage of the second to fourth electrolytic capacitors EC2, EC3, and EC4 is higher than the voltage of the first LED array LA1 is determined by the capacitance and a product of the current of the second to fourth channels CH2, CH3, and CH4 and the time to be designed at a desired level.

Further, since the voltage of the second to fourth electrolytic capacitors EC2, EC3, and EC4 is almost the same as the voltage of the first LED array LA1 only when the charges charged in the second to fourth electrolytic capacitors EC2, EC3, and EC4 should be discharged at a short time during discharging through the parallel connection of the first LED array LA1 and the first electrolytic capacitor EC1—the path of the first channel CH1, the current driving capability of the first channel CH1 should be very large.

The first channel CH1 performs a normal operation only when satisfying a current capacity or more such as the following Equation.

Current capacity of first channel CH1>(Sum of average charge amounts filled in second to fourth electrolytic capacitors EC2, EC3, and EC4/(Discharge time) [Equation 2]

Here, the discharge time is part of the time when the input current is '0', that is, the AC source 10 is shut off.

Figure 3:
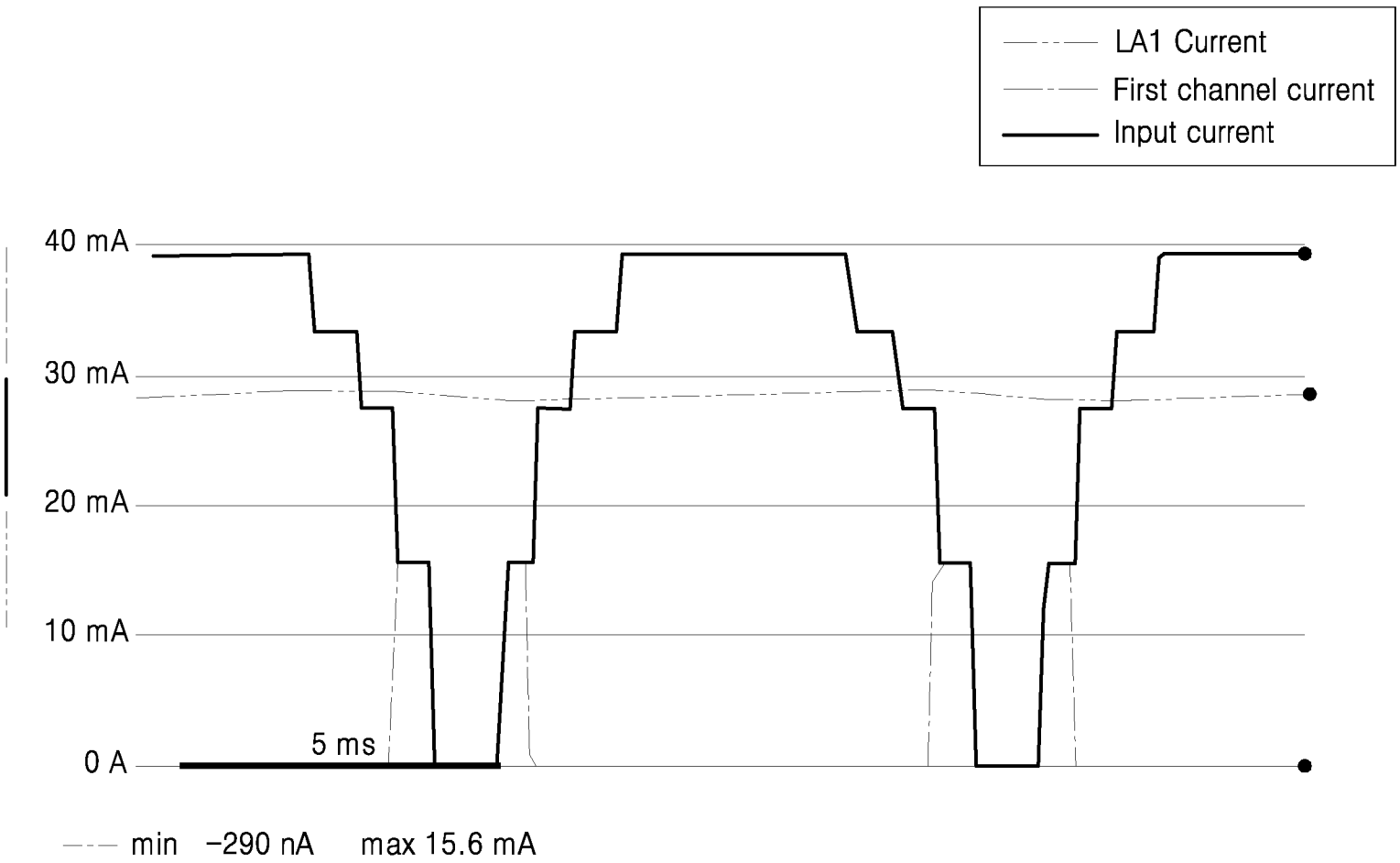
FIG. 3 (PRIOR ART)
FIG. 3 is a graph showing waveforms as a result of simulating an input current in the LED lighting device illustrated in FIG. 1, a current flowing in a first LED array LA1, and a current flowing in a first channel CH1.

Meanwhile, as illustrated in FIG. 6, by configuring four stages of the first LED array LA1 and the first to third charging/discharging units 210, 220, and 230, the present disclosure is the same as the conventional AC source direct driving LED lighting device illustrated in FIG. 3 in that an input current variation step is formed in four steps.

However, the present disclosure is different from the conventional AC source direct driving LED lighting device illustrated in FIG. 3 in that the LED current is concentrated to one 36 V first LED array LA1 to be higher than the input current.

The entire LED power is a value of calculating a product of the voltage and the current of the first LED array LA1, and as illustrated in FIG. 7, the current of the first channel CH1 is the same as the conventional AC source direct driving LED lighting device during the input current driving.

However, when the input current is not driven, it can be seen that while the charges which have been charged in the second to fourth electrolytic capacitors EC2, EC3, and EC4 are discharged, the input current is driven to a pulse type current higher than the currents of three LED arrays LA1, LA2, and LA3 in the conventional AC source direct driving LED lighting device illustrated in FIG. 3.

As such, there is provided an AC source direct driving LED lighting device capable of minimizing the number of connection lines between the light emitting unit and the current driving unit to decrease the volume of the power supply device of the LED driving lighting device and facilitate the component assembling.

Further, there is provided an AC source direct driving LED lighting device capable of stably performing a charging/discharging operation of the LED driving lighting device by decreasing the number of LED arrays in the light emitting unit without reduction of power conversion efficiency.

Through this, there is no need to switch a high current at a high frequency so that the current flows through an inductor, and as a result, as an electromagnetic wave interference phenomenon is prevented, a filter circuit for filtering the high frequency becomes unnecessary.

Further, since a deviation of the lighting-on between LED arrays is removed as compared to the conventional sequential lighting method, the uniformity of the LED lighting is remarkably improved.

As described above, although several preferred embodiments of the present disclosure have been described with some examples, the descriptions of various exemplary embodiments described in the "detailed description for implementing the Invention" item are merely exemplary, and it will be appreciated by those skilled in the art that the present disclosure can be variously modified and carried out or equivalent executions to the present disclosure can be performed from the above description.

In addition, since the present disclosure can be implemented in various other forms, the present disclosure is not limited by the above description, and the above description is for the purpose of completing the disclosure of the present disclosure, and the above description is just provided to completely inform those skilled in the art of the scope of the present disclosure, and it should be known that the present disclosure is only defined by each of the claims.

What is claimed is:

1. An AC source direct driving LED lighting device comprising:

a light emitting unit which has a first electrolytic capacitor and receives a rectified AC voltage to adjust a first constant current and emits LED arrays;

a charging/discharging unit which receives the adjusted first constant current to be adjusted to second to fourth constant currents and charges/discharges embedded second to fourth electrolytic capacitors, respectively;

a discharge LED path unit which forms a path of discharging the voltage charged in the charging/discharging unit to the light emitting unit; and a current driving unit which receives the adjusted first to fourth constant currents to form first to fourth channels using first to fourth reference voltages and controls current transfer.

2. The AC source direct driving LED lighting device of claim 1, wherein the charging/discharging unit comprises:

a first charging/discharging unit which receives the adjusted first constant current to be adjusted to the second constant current and charges/discharges the second electrolytic capacitor;

a second charging/discharging unit which receives the adjusted second constant current to be adjusted to the third constant current and charges/discharges the third electrolytic capacitor; and a third charging/discharging unit which receives the adjusted third constant current to be adjusted to the fourth constant current and charges/discharges the fourth electrolytic capacitor.

3. The AC source direct driving LED lighting device of claim 2, further comprising:

a rectification unit which receives and rectifies an AC voltage from an AC source to output the rectified AC voltage; and first to fourth isolation diodes which electrically isolate the light emitting unit and the first to third charging/discharging units which are connected in parallel, from each other.

4. The AC source direct driving LED lighting device of claim 3, wherein the light emitting unit comprises:

the first electrolytic capacitor of which one side is connected to a cathode terminal of the first isolation diode and the other side is connected to an anode terminal of the second isolation diode to charge a first charge;

a first discharge resistor which is connected to the first electrolytic capacitor in parallel to discharge the charged first charge; and the LED array which includes a plurality of LEDs, is connected to the first electrolytic capacitor in parallel, and receives a rectified AC voltage passing through the first isolation diode to emit light.

5. The AC source direct driving LED lighting device of claim 3, wherein the first charging/discharging unit comprises:

the second electrolytic capacitor of which one side is connected to a cathode terminal of the second isolation diode to charge a second charge; and a second discharge resistor which is connected to the second electrolytic capacitor in parallel to discharge the charged second charge.

6. The AC source direct driving LED lighting device of claim 3, wherein the second charging/discharging unit comprises:

the third electrolytic capacitor of which one side is connected to a cathode terminal of the third isolation diode to charge a third charge; and a third discharge resistor which is connected to the third electrolytic capacitor in parallel to discharge the charged third charge.

7. The AC source direct driving LED lighting device of claim 3, wherein the third charging/discharging unit comprises:

the fourth electrolytic capacitor of which one side is connected to a cathode terminal of the fourth isolation diode to charge a fourth charge; and a fourth discharge resistor which is connected to the fourth electrolytic capacitor in parallel to discharge the charged fourth charge.

8. The AC source direct driving LED lighting device of claim 1, further comprising:

a reference voltage generation unit which generates and outputs the first to fourth reference voltages that are gradually increasing;

a channel isolation unit which isolates the second to fourth channels from the charging/discharging unit when discharging the charging/discharging unit; and a discharge capacitor path unit which forms a discharge path to the first channel from the second to fourth electrolytic capacitors when the second to fourth channels are isolated.

9. The AC source direct driving LED lighting device of claim 8, wherein the channel isolation unit comprises:

a first channel isolation diode of which an anode terminal is connected to the other side of the second electrolytic capacitor and a cathode terminal is connected to an input terminal of the current driving unit to be electrically isolated from the second channel when discharging the second electrolytic capacitor;

a second channel isolation diode of which an anode terminal is connected to the other side of the third electrolytic capacitor and a cathode terminal is connected to an input terminal of the current driving unit to be electrically isolated from the third channel when discharging the third electrolytic capacitor; and a third channel isolation diode of which an anode terminal is connected to the other side of the fourth electrolytic capacitor and a cathode terminal is connected to an input terminal of the current driving unit to be electrically isolated from the fourth channel when discharging the fourth electrolytic capacitor.

10. The AC source direct driving LED lighting device of claim 9, wherein the discharge capacitor path unit comprises:

a first discharge path diode of which a cathode terminal is connected to the other side of the second electrolytic capacitor and an anode terminal is connected to an output terminal of the current driving unit to form a discharge path to the first channel from the second electrolytic capacitor when the second to fourth channels are isolated;

a second discharge path diode of which a cathode terminal is connected to the other side of the third electrolytic capacitor and an anode terminal is connected to an output terminal of the current driving unit to form a discharge path to the first channel from the third electrolytic capacitor when the second to fourth channels are isolated; and a third discharge path diode of which a cathode terminal is connected to the other side of the fourth electrolytic capacitor and an anode terminal is connected to an output terminal of the current driving unit to form a discharge path to the first channel from the fourth electrolytic capacitor when the second to fourth channels are isolated.

11. The AC source direct driving LED lighting device of claim 1, wherein the discharge LED path unit comprises:

a first diode of which an anode terminal is connected to one side of the second electrolytic capacitor and a cathode terminal is connected to the light emitting unit to form a path of discharging the voltage, which has been charged in the second electrolytic capacitor, to the light emitting unit;

a second diode of which an anode terminal is connected to one side of the third electrolytic capacitor and a cathode terminal is connected to the light emitting unit to form a path of discharging the voltage, which has been charged in the third electrolytic capacitor, to the light emitting unit; and a third diode of which an anode terminal is connected to one side of the fourth electrolytic capacitor and a cathode terminal is connected to the light emitting unit to form a path of discharging the voltage, which has been charged in the fourth electrolytic capacitor, to the light emitting unit.

12. The AC source direct driving LED lighting device of claim 9, wherein the current driving unit comprises:

a first channel current driving unit which receives the adjusted first constant current from the light emitting unit through a first transistor to control the driving of the current of the first channel according to an opening/closing of the first transistor depending on the control of a first comparator;

a second channel current driving unit which receives the current from the first channel isolation diode through a second transistor to control the driving of the current of the second channel according to an opening/closing of the second transistor depending on the control of a second comparator;

a third channel current driving unit which receives the current from the second channel isolation diode through a third transistor to control the driving of the current of the third channel according to an opening/closing of the third transistor depending on the control of a third comparator; and a fourth channel current driving unit which receives the current from the third channel isolation diode through a fourth transistor to control the driving of the current of the fourth channel according to an opening/closing of the fourth transistor depending on the control of a fourth comparator.

13. An AC source direct driving LED lighting device comprising:

a light emitting unit which has a first electrolytic capacitor and receives a rectified AC voltage to adjust a first constant current and emits LED arrays;

a charging/discharging unit which receives the adjusted first constant current to be adjusted to second to fourth constant currents and charges/discharges embedded second to fourth electrolytic capacitors, respectively;

a discharge LED path unit which forms a path of discharging the voltage charged in the charging/discharging unit to the light emitting unit; and a current driving unit which receives the adjusted first to fourth constant currents to form first to fourth channels using first to fourth reference voltages and controls current transfer, wherein an operation of being charged in the second to fourth electrolytic capacitors when the rectified AC current is applied and an operation of being discharged through the light emitting unit when the rectified AC current is applied lower than the voltages of the light emitting unit and the charging/discharging unit are repeated.

* * * * *